US007883549B2

(12) United States Patent
Penninger et al.

(10) Patent No.: US 7,883,549 B2
(45) Date of Patent: Feb. 8, 2011

(54) GRAYING-INHIBITING LIQUID WASHING COMPOSITION

(75) Inventors: Josef Penninger, Hilden (DE); Nadine Warkotsch, Dusseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 12/183,493

(22) Filed: Jul. 31, 2008

(65) Prior Publication Data

US 2008/0313819 A1 Dec. 25, 2008

Related U.S. Application Data

(63) Continuation of application No. PCT/EP2007/001341, filed on Feb. 16, 2007.

(30) Foreign Application Priority Data

Feb. 28, 2006 (DE) ..... 10 2006 009 578

(51) Int. Cl.
*B08B 3/04* (2006.01)
*C11D 1/02* (2006.01)
*C11D 3/22* (2006.01)
*C11D 9/02* (2006.01)

(52) U.S. Cl. ..... 8/137; 510/353; 510/389; 510/426; 510/437; 510/473; 510/481; 424/480

(58) Field of Classification Search ..... 510/353, 510/389, 426, 437, 473, 481; 8/137; 424/480
See application file for complete search history.

(56) References Cited

U.S. PATENT DOCUMENTS 2,994,665 A * 8/1961 Reich et al. ..... 510/337
5,604,195 A * 2/1997 Misselyn et al. ..... 510/400

FOREIGN PATENT DOCUMENTS

WO WO 94/12608 * 6/1994

* cited by examiner

*Primary Examiner*—Brian P Mruk
(74) *Attorney, Agent, or Firm*—David P. LeCroy

(57) ABSTRACT

An aqueous liquid laundry detergent containing methylcarboxymethyl cellulose having a degree of methylation in the range from 0.01 to 0.3, surfactant, and at least one typical ingredient of laundry detergents. The detergent inhibits graying of textile fabrics during the washing of the fabrics.

18 Claims, No Drawings

GRAYING-INHIBITING LIQUID WASHING COMPOSITION

CROSS-REFERENCE TO RELATED APPLICATIONS

This application is a continuation under 35 U.S.C. Section 365(c) and 35 U.S.C. Section 120 of International Application No. PCT/EP2007/001341, filed Feb. 16, 2007. This application also claims priority under 35 U.S.C. Section 119 of German Patent Application No. DE 10 2006 009 578.2, filed Feb. 28, 2006. Both the International Application and the German Application are incorporated herein by reference in their entireties.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION (1) Field of the Invention

The invention relates to a liquid surfactant-containing laundry detergent that contains a specific cellulose derivative as a graying-inhibiting active substance.

The purpose of graying inhibitors is to keep dirt released from the fibers in the context of textile washing suspended in the bath, thus preventing the dirt from redepositing onto the textile. Water-soluble colloids, usually organic in nature, are suitable for this, for example size, gelatin, salts of ethersulfonic acids of starch or of cellulose, or salts of acid sulfuric acid esters of cellulose or starch. Water-soluble polyamides containing acid groups are also suitable for this purpose. Soluble starch preparations, and starch products other than those mentioned above, can also be used, e.g. degraded starch, aldehyde starches, etc. Polyvinylpyrrolidone is also usable. Cellulose ethers such as carboxymethyl cellulose (Na salt), methyl cellulose, hydroxyalkyl cellulose, and mixed ethers such as methylhydroxyethyl cellulose, methylhydroxypropyl cellulose, methylcarboxymethyl cellulose, and mixtures thereof, are also often used, normally in quantities from 0.1 to 5 wt % based on the laundry detergent.

Although the aforesaid cellulose ethers have a good graying-inhibiting action, their use in aqueous liquid laundry detergents is subject to such narrow limits that in practice, they cannot be incorporated into them. The reason is that in addition to their graying-inhibitor effect that is relevant only in the context of use in washing methods, these cellulose ethers have comparatively low solubility in surfactant-containing systems, and have a pronounced thickening effect on aqueous systems. When they are incorporated into aqueous and in particular anionic surfactant-containing liquid laundry detergents at the concentrations desired for graying-inhibiting action, either the products obtained are generally no longer able to flow and be poured, and can be made usable for the consumer only with additional effort, for example preparation in individual dispensing portions packaged in water-soluble or tear-open water-insoluble fashion; or the cellulose ethers, especially after storage, are not completely dissolved in the aqueous liquid laundry detergent, which results not only in an inadequate aesthetic impression but also in non-uniform dispensing of the graying-inhibiting active substance when the detergent containing it is used.

(2) Description of Related Art, Including Information Disclosed Under 37 C.F.R. Sections 1.97 and 1.98

Not Applicable

BRIEF SUMMARY OF THE INVENTION

It has now been found, surprisingly, that a good graying-inhibiting effect can be obtained in aqueous liquid laundry detergents, without an unreasonable viscosity increase or precipitation, when methylcarboxymethyl cellulose having a low degree of methylation is used.

The subject of the invention is an aqueous liquid laundry detergent containing surfactant as well as, if applicable, further usual ingredients of laundry detergents and cleaning agents, the detergent containing methylcarboxymethyl cellulose having a degree of methylation in the range from 0.01 to 0.3, in particular 0.5 to 0.2. This means that on average, 0.01 to 0.3, in particular 0.5 to 2.0, methyl groups per anhydroglycose monomer unit are contained in the cellulose derivative. The degree of carboxymethylation, which correspondingly indicates the average number of carboxymethyl groups per anhydroglycose monomer unit, is by preference in the range from 0.3 to 1, in particular 0.4 to 0.8. The average molar weight of the cellulose derivative used according to the present invention is by preference in the range from 80,000 D to 300,000 D, in particular from 100,000 D to 280,000 D, and particularly preferably in the range from 150,000 D to 250,000 D. Determination of the degree of polymerization and molecular weight of the cellulose ether can be performed based on a determination of the limit viscosity number in sufficiently diluted aqueous solutions using an Ubbelohde capillary viscosimeter (e.g. capillary 0c). From this, the degree of polymerization and (incorporating the degrees of substitution) the corresponding molecular weight can be calculated.

BRIEF DESCRIPTION OF THE SEVERAL VIEWS OF THE DRAWING(S)

Not Applicable

DETAILED DESCRIPTION OF THE INVENTION

The methylcarboxymethyl cellulose suitable according to the present invention can be manufactured in the usual way by reacting cellulose with methylating agents such as, for example, chloromethane, and subsequent reaction with carboxymethylating agents such as, for example, chloracetic acid, in the corresponding molar equivalents.

A detergent according to the present invention contains by preference 0.1 wt % to 2 wt %, in particular 0.3 wt % to 1.5 wt %, of the aforesaid methylcarboxymethyl cellulose.

The invention also relates to use of the aforesaid low-methylated methylcarboxymethyl cellulose in aqueous liquid laundry detergents to improve graying inhibition when washing textile fabrics using the aqueous liquid laundry detergent.

The laundry detergent according to the present invention contains, in addition to the aforesaid cellulose ether derivative and surfactants further explained below, water, in quantities (based on the entire detergent) of by preference up to approximately 85 wt % and in particular from 40 wt % to 75 wt %; if desired, this can also be replaced in part by a water-soluble solvent component. Nonaqueous solvents that can be used in the liquid detergents and agents derive, for example, from the group of the monovalent or polyvalent alcohols, alkanolamines, or glycol ethers, provided they are miscible with water in the concentration range indicated. The solvents are by preference selected from ethanol, n- or isopropanol, the butanols, ethylene glycol, butanediol, glycerol, diethylene glycol, butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl, or propyl ether, dipropylene glycol monomethyl or -ethyl ether, diisopropylene glycol monomethyl or -ethyl ether, methoxy-, ethoxy-, or butoxytriglycol, 1-butoxyethoxy-2-propanol, 3-methyl-3-methoxybutanol, propylene glycol t-butyl ether, and mixtures thereof. The quantity of the nonaqueous water-soluble solvent component, based on the total quantity of the laundry detergent and cleaning agent, is by preference up to 15 wt %, in particular 0.5 wt % to 10 wt %.

The liquid laundry detergents contain surfactant, in which context anionic, nonionic, cationic, and/or amphoteric surfactants can be used. The presence of anionic surfactants is preferred, mixtures of anionic and nonionic surfactants being particularly advantageous from the standpoint of applications engineering. The total surfactant content of the liquid detergent is by preference in the range from 10 wt % to 60 wt %, in particular 15 wt % to 50 wt %, based in each case on the entire liquid detergent.

The nonionic surfactants used are by preference alcohol alkoxylates, i.e., alkoxylated, advantageously ethoxylated, in particular primary, alcohols having by preference 8 to 18 carbon atoms and an average of 1 to 12 mol ethylene oxide (EO) per mol of alcohol, in which the alcohol radical can be linear or preferably methyl-branched in the 2-position, or can contain mixed linear and methyl-branched radicals, such as those usually present in oxoalcohol radicals. Particularly preferred, however, are alcohol ethoxylates having linear radicals made up of alcohols of natural origin having 12 to 18 carbon atoms, e.g., from coconut, palm, tallow, or oleyl alcohol, and an average of 2 to 8 EO per mol of alcohol. The preferred ethoxylated alcohols include, for example, $C_{12-14}$ alcohols having 3 EO, 4 EO, or 7 EO, $C_{9-11}$ alcohols having 7 EO, $C_{13-15}$ alcohols having 3 EO, 5 EO, 7 EO, or 8 EO, $C_{12-18}$ alcohols having 3 EO, 5 EO, or 7 EO, and mixtures thereof, such as mixtures of $C_{12-14}$ alcohol having 3 EO and $C_{12-18}$ alcohol having 7 EO. The degrees of ethoxylation that are indicated represent statistical averages, which for a specific product may be a whole or fractional number. Preferred alcohol ethoxylates exhibit a restricted homolog distribution (=narrow range ethoxylates, NRE). In addition to these nonionic surfactants, fatty alcohols having more than 12 EO can also be used. Examples of these are tallow fatty alcohol having 14 EO, 25 EO, 30 EO, or 40 EO. Nonionic surfactants that contain EO and PO groups together in the molecule are also usable according to the present invention. Block copolymers having EO-PO block units or PO-EO block units, but also EO-PO-EO copolymers or PO-EO-PO copolymers, can be used in this context. Also usable are mixed alkoxylated nonionic surfactants in which EO and PO units are distributed statistically rather than in block fashion. Such products are obtainable by the simultaneous action of ethylene oxide and propylene oxide on fatty alcohols.

It is also possible to use as nonionic surfactants alkylglycosides of the general formula $RO(G)_x$, in which R denotes a primary straight-chain or methyl-branched (in particular methyl-branched in the 2-position) aliphatic radical having 8 to 22, preferably 12 to 18 carbon atoms; and G is the symbol denoting a glycose unit having 5 or 6 carbon atoms, preferably glucose. The degree of oligomerization x, which indicates the distribution of monoglycosides and oligoglycosides, is any number between 1 and 10; x is by preference between 1.2 and 1.4.

A further class of nonionic surfactants used in preferred fashion, which are used either as the only nonionic surfactant or in combination with other nonionic surfactants, is alkoxylated, preferably ethoxylated or ethoxylated and propoxylated, fatty acid alkyl esters, by preference having 1 to 4 carbon atoms in the alkyl chain, in particular fatty acid methyl esters.

Nonionic surfactants of the amine oxide type, for example N-cocalkyl-N,N-dimethylamine oxide and N-tallowalkyl-N,N-dihydroxyethylamine oxide, and the fatty acid alkanolamides, can also be suitable. The quantity of these nonionic surfactants is by preference no more than that of the ethoxylated fatty alcohols, in particular no more than half thereof.

Further suitable surfactants are polyhydroxy fatty acid amides of formula (I)

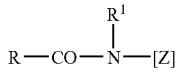

(I)

in which RCO denotes an aliphatic acyl radical having 6 to 22 carbon atoms; $R^1$ denotes hydrogen, an alkyl or hydroxyalkyl radical having 1 to 4 carbon atoms; and [Z] denotes a linear or branched polyhydroxyalkyl radical having 3 to 10 carbon atoms and 3 to 10 hydroxyl groups. The polyhydroxy fatty acid amides are known substances that can usually be obtained by reductive amination of a reducing sugar with ammonia, an alkylamine, or an alkanolamine, and subsequent acylation with a fatty acid, a fatty acid alkyl ester, or a fatty acid chloride. Also belonging to the group of the polyhydroxy fatty acid amides are compounds of formula (II)

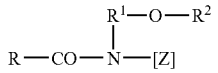

(II)

in which R denotes a linear or branched alkyl or alkenyl radical having 7 to 12 carbon atoms; $R^1$ denotes a linear, branched, or cyclic alkyl radical or an aryl radical having 2 to 8 carbon atoms; and $R^2$ denotes a linear, branched, or cyclic alkyl radical or an aryl radical or an oxyalkyl radical having 1 to 8 carbon atoms, $C_{1-4}$ alkyl or phenyl radicals being preferred; and [Z] denotes a linear polyhydroxyalkyl radical whose alkyl chain is substituted with at least two hydroxyl groups, or alkoxylated, preferably ethoxylated or propoxylated, derivatives of that radical. [Z] is preferably obtained by reductive amination of a sugar, for example glucose, fructose, maltose, lactose, galactose, mannose, or xylose. The N-alkoxy- or N-aryloxy-substituted compounds can then be converted into the desired polyhydroxy fatty acid amides by reaction with fatty acid methyl esters in the presence of an alkoxide as catalyst.

The concentration of nonionic surfactants in the liquid laundry detergents is by preference 5 wt % to 30 wt %, in particular 7 wt % to 20 wt %, and particularly preferably 9 wt % to 15 wt %, based in each case on the entire detergent. In a preferred embodiment, the nonionic surfactant is selected from alcohol alkoxylate and alkypolyglycoside and mixtures thereof.

Anionic surfactants that can be used are, for example, those of the sulfonate and sulfate types. Possibilities as surfactants of the sulfonate type are, by preference, $C_{9-13}$ alkylbenzenesulfonates, olefinsulfonates, i.e., mixtures of alkene- and hydroxyalkanesulfonates, and disulfonates, for example such as those obtained from $C_{12-18}$ monoolefins having a terminal or internal double bond, by sulfonation with gaseous sulfur trioxide and subsequent alkaline or acid hydrolysis of the sulfonation products. Also suitable are alkanesulfonates that are obtained from $C_{12-18}$ alkanes, for example by sulfochlorination or sulfoxidation with subsequent hydrolysis and neutralization. The esters of α-sulfo fatty acids (estersulfonates), for example the α-sulfonated methyl esters of hydrogenated coconut, palm kernel, or tallow fatty acids, are likewise suitable.

Further suitable anionic surfactants are sulfonated fatty acid glycerol esters. "Fatty acid glycerol esters" are to be understood as the mono-, di- and triesters, and mixtures thereof, that are obtained during the production by esterification of a monoglycerol with 1 to 3 mol fatty acid, or upon transesterification of triglycerides with 0.3 to 2 mol glycerol. Preferred sulfonated fatty acid glycerol esters are the sulfonation products of saturated fatty acids having 6 to 22 carbon atoms, for example hexanoic acid, octanoic acid, decanoic acid, myristic acid, lauric acid, palmitic acid, stearic acid, or behenic acid.

Preferred alk(en)yl sulfates are the alkali, and in particular sodium, salts of the sulfuric acid semi-esters of the $C_{12}$-$C_{18}$ fatty alcohols, for example from coconut fatty alcohol, tallow fatty alcohol, lauryl, myristyl, cetyl, or stearyl alcohol, or the $C_{10}$-$C_{20}$ oxo alcohols, and those semi-esters of secondary alcohols of those chain lengths. Additionally preferred are alk(en)yl sulfates of the aforesaid chain length that contain a synthetic straight-chain alkyl radical produced on a petrochemical basis, which possess a breakdown behavior analogous to those appropriate compounds based on fat-chemistry raw materials. For purposes of washing technology, the $C_{12}$-$C_{16}$ alkyl sulfates and $C_{12}$-$C_{15}$ alkyl sulfates, as well as $C_{14}$-$C_{15}$ alkyl sulfates, are preferred. 2,3-Alkyl sulfates that can be obtained, for example, as commercial products of the Shell Oil Company under the name DAN®, are also suitable anionic surfactants.

The sulfuric acid monoesters of the aforesaid alcohol alkoxylates, for example of the straight-chain or branched $C_{7-21}$ alcohols ethoxylated with 1 to 6 mol ethylene oxide, such as 2-methyl-branched $C_{9-11}$ alcohols having an average of 3.5 mol ethylene oxide (EO) or $C_{12-18}$ fatty alcohols having 1 to 4 EO, are also suitable. These are often also referred to as ether sulfates.

Other suitable anionic surfactants are also the salts of alkylsulfosuccinic acid, which are also referred to as sulfosuccinates or as sulfosuccinic acid esters and represent the monoesters and/or diesters of sulfosuccinic acid with alcohols, preferably fatty alcohols, and in particular ethoxylated fatty alcohols. Preferred sulfosuccinates contain $C_{8-18}$ fatty alcohol radicals or mixtures thereof. Particularly preferred sulfosuccinates contain a fatty alcohol radical that is derived from ethoxylated fatty alcohols which, considered per se, represent nonionic surfactants (see below for description). Sulfosuccinates whose fatty alcohol radicals derive from ethoxylated fatty alcohols having a restricted homolog distribution are, in turn, particularly preferred. It is likewise also possible to use alk(en)yl succinic acid having by preference 8 to 18 carbon atoms in the alk(en)yl chain, or salts thereof.

Preferred anionic surfactants are soaps. Saturated and unsaturated fatty acid soaps, such as the salts of lauric acid, myristic acid, palmitic acid, stearic acid, (hydrogenated) erucic acid, and behenic acid, are suitable, as are soap mixtures derived in particular from natural fatty acids, e.g., coconut, palm kernel, olive oil or tallow fatty acids. In a preferred embodiment, the laundry detergent contains 2 wt % to 20 wt %, in particular 3 wt % to 15 wt %, and particularly preferably 5 wt % to 10 wt %, fatty acid soap. Fatty acid soaps are an important constituent in terms of the washing power of a liquid, in particular aqueous, laundry detergent and cleaning agent. It has been found, surprisingly, that when the low-methylated carboxymethyl cellulose ether is used, clear and stable liquid laundry detergents are obtained even in the presence of a large quantity of fatty acid soap. The use of large quantities (≧2 wt %) of fatty acid soap in such systems usually results in cloudy and/or unstable products.

The anionic surfactants, including the soaps, can be present in the form of their sodium, potassium, or ammonium salts, and as soluble salts of organic bases, such as mono-, di-, or triethanolamine. The anionic surfactants are preferably present in the form of their sodium or potassium salts, in particular in the form of the sodium salts.

The concentration of anionic surfactants in preferred liquid laundry detergents is 5 wt % to 35 wt %, in particular 8 wt % to 30 wt %, and particularly preferably 10 wt % to 25 wt %, based in each case on the entire detergent. It is particularly preferred that the quantity of fatty acid soap be at least 2 wt %, particularly preferably at least 3 wt %, and in particular 4 wt % to 10 wt %. In a further preferred embodiment, the detergents contain at least two, in particular three, different anionic surfactants, selected from alkylbenzenesulfonate, ether sulfate, and fatty acid soap.

The laundry detergent can contain a polyacrylate acting as a cobuilder and, if applicable, also as a thickener. Among the polyacrylates are polyacrylate or polymethacrylate thickeners such as, for example, the high-molecular-weight homopolymers of acrylic acid cross-linked with a polyalkenyl polyether, in particular an allyl ether, of sucrose, pentaerythritol, or propylene (INCI name, according to "International Dictionary of Cosmetic Ingredients" of the Cosmetic, Toiletry and Fragrance Association (CFTA): Carbomer), which are also referred to as carboxyvinyl polymers. Polyacrylic acids of this kind are obtained from, among other sources, the 3V Sigma company under the trade name Polygel®, e.g., Polygel DA, and from the Noveon company under the trade name Carbopol®, e.g., Carbopol 940 (molecular weight approx. 4,000,000), Carbopol 941 (molecular weight approx. 1,250,000), or Carbopol 934 (molecular weight approx. 3,000,000). Also included are the following acrylic acid copolymers: (i) copolymers of two or more monomers from the group of acrylic acid, methacrylic acid, and their simple esters, formed by preference with $C_{1-4}$ alkanols (INCI: Acrylates Copolymer), included among which are, for example, the copolymers of methacrylic acid, butyl acrylate, and methyl methacrylate (CAS designation according to Chemical Abstracts Service: 25035-69-2), or of butyl acrylate and methyl methacrylate (CAS 25852-37-3), and which are obtainable, for example, from the Rohm & Haas company under the trade names Aculyn® and Acusol®, and from the Degussa (Goldschmidt) company under the trade name Tego® Polymer, e.g., the anionic nonassociative polymers Aculyn 22, Aculyn 28, Aculyn 33 (cross-linked), Acusol 810, Acusol 823, and Acusol 830 (CAS 25852-37-3); (ii) cross-linked high-molecular-weight acrylic acid copolymers, included among which are, for example, the copolymers, cross-linked with an allyl ether of sucrose or of pentaerythritol, of $C_{10-30}$ alkyl acrylates with one or more monomers from the group of acrylic acid, methacrylic acid, and their simple esters formed preferably with $C_{1-4}$ alkanols (INCI: Acrylates/

$C_{10-30}$ Alkyl Acrylate Crosspolymer), and which are obtainable, for example, from the Noveon company under the trade name Carbopol®, e.g., the hydrophobized Carbopol ETD 2623 and Carbopol 1382 (INCI: Acrylates/$C_{10-30}$ Alkyl Acrylate Crosspolymer), and Carbopol Aqua 30 (formerly Carbopol EX 473). Preferred liquid laundry detergents contain the polyacrylate in a quantity of up to 5 wt %, in particular from 0.1 wt % to 2.5 wt %. It is advantageous if the polyacrylate is a copolymer of an unsaturated mono- or dicarboxylic acid and of one or more $C_1$-$C_{30}$ alkyl esters of (meth)acrylic acid.

The viscosity of the liquid laundry detergents and cleaning agents can be measured with usual standard methods (e.g., Brookfield LVT-II viscosimeter at 20 rpm and 20° C., spindle 3), and is by preference in the range from 150 mPas to 5,000 mPas. Preferred detergents and agents have viscosities from 500 mPas to 4,000 mPas, values from 1,000 mPas to 3,500 mPas being particularly preferred.

The liquid laundry detergents can additionally contain further ingredients that further improve their applications-engineering and/or aesthetic properties. In the context of the present invention, preferred detergents contain one or more substances from the group of the detergency builders, bleaching agents, bleach activators, enzymes, electrolytes, pH adjusting agents, fragrances, perfume carriers, fluorescent agents, dyes, hydrotropes, foam inhibitors, additional anti-redeposition agents or graying inhibitors, optical brighteners, shrinkage preventers, wrinkle protection agents, color transfer inhibitors, antimicrobial active substances, germicides, fungicides, antioxidants, corrosion inhibitors, antistatic agents, ironing adjuvants, proofing and impregnating agents, swelling and anti-slip agents, and UV absorbers.

Silicates, aluminum silicates (in particular zeolites), carbonates, salts of organic di- and polycarboxylic acids, and mixtures of these substances, may be mentioned as detergency builders that can be contained in the liquid detergents and agents.

Suitable crystalline, sheet-form sodium silicates possess the general formula $NaMSi_xO_{2x+1}.H_2O$, where M denotes sodium or hydrogen, x is a number from 1.9 to 4, and y is a number from 0 to 20, and preferred values for x are 2, 3, or 4. Preferred crystalline sheet silicates of the formula indicated above are those in which M denotes sodium and x assumes the value 2 or 3. Both β- and δ-sodium disilicates $Na_2Si_2O_5.yH_2O$ are particularly preferred.

Also usable are amorphous sodium silicates having a $Na_2O:SiO_2$ modulus from 1:2 to 1:3.3, preferably 1:2 to 1:2.8, and in particular 1:2 to 1:2.6, which are dissolution-delayed and exhibit secondary washing properties. The dissolution delay as compared with conventional amorphous sodium silicates can have been brought about in various ways, for example by surface treatment, compounding, compacting/densification, or overdrying. In the context of this invention, the term "amorphous" is also understood to mean "X-amorphous." In other words, in X-ray diffraction experiments the silicates yield not the sharp X-ray reflections that are typical of crystalline substances, but at most one or more maxima in the scattered X radiation that have a width of several degree units of the diffraction angle. Particularly good builder properties can, however, very easily be obtained even if the silicate particles yield blurred or even sharp diffraction maxima in electron beam diffraction experiments. This may be interpreted to mean that the products comprise microcrystalline regions 10 to several hundred nm in size, values of up to a maximum of 50 nm, and in particular a maximum of 20 nm, being preferred. X-amorphous silicates of this kind likewise exhibit a dissolution delay as compared with conventional water glasses. Densified/compacted amorphous silicates, compounded amorphous silicates, and overdried X-amorphous silicates are particularly preferred.

The finely crystalline synthetic zeolite containing bound water that is used is by preference zeolite A and/or zeolite P. Zeolite MAP® (commercial product of the Crosfield company) is particularly preferred as zeolite P. Also suitable, however, are zeolite X as well as mixtures of A, X, and/or P. Also commercially available and preferably usable in the context of the present invention is, for example, a co-crystal of zeolite X and zeolite A (approx. 80 wt % zeolite X) that is marketed by the Sasol company under the trade name VEGOBOND AX® and can be described by the formula $$n\mathrm{Na_2O}(1-n)\mathrm{K_2O}.\mathrm{Al_2O_3}.(2-2.5)\mathrm{SiO_2}.(3.5-5.5)\mathrm{H_2O},$$

where n=0.90-1.0. The zeolite can be used as a spray-dried powder or also as an undried stabilized suspension still moist as manufactured. In the event the zeolite is used as a suspension, it can contain small additions of nonionic surfactants as stabilizers, for example 1 to 3 wt %, based on the zeolite, of ethoxylated $C_{12}$-$C_{18}$ fatty alcohols having 2 to 5 ethylene oxide groups, $C_{12}$-$C_{14}$ fatty alcohols having 4 to 5 ethylene oxide groups, or ethoxylated isotridecanols. Suitable zeolites exhibit an average particle size of less than 10 μm (volume distribution; measurement method: Coulter Counter), and by preference contain 18 to 22 wt %, in particular 20 to 22 wt %, bound water.

Use of the commonly known phosphates as builder substances is also possible, provided such use is not to be avoided for environmental reasons. The sodium salts of the orthophosphates, pyrophosphates, and in particular tripolyphosphates are particularly suitable.

Among the compounds yielding $H_2O_2$ in water and serving as bleaching agents, sodium perborate tetrahydrate and sodium perborate monohydrate have particular importance. Additional usable bleaching agents are, for example, sodium percarbonate, peroxypyrophosphates, citrate perhydrates, and peracid salts or peracids that yield $H_2O_2$, such as perbenzoates, peroxophthalates, diperazelaic acid, phthaloimino peracid, or diperdodecanedioic acid. If present, these are used by preference in encased form in order to protect them from disintegration during storage.

To achieve an improved bleaching effect when washing at temperatures of 60° C. and below, bleach activators can be incorporated into the laundry detergents and washing agents. Compounds that, under perhydrolysis conditions, yield aliphatic peroxycarboxylic acids having by preference 1 to 10 carbon atoms, in particular 2 to 4 carbon atoms, and/or optionally substituted perbenzoic acid, can be used as bleach activators. Substances that carry O— and/or N-acyl groups having the aforesaid number of carbon atoms, and/or that carry optionally substituted benzoyl groups, are suitable. Multiply acylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetyl glycoluril (TAGU), N-acylimides, in particular N-nonanoyl succinimide (NOSI), acylated phenolsulfonates, in particular n-nonanoyl- or isononanoyloxybenzenesulfonate (n- and iso-NOBS), carboxylic acid anhydrides, in particular phthalic acid anhydride, acylated polyvalent alcohols, in particular triacetin, ethylene glycol diacetate, and 2,5-diacetoxy-2,5-dihydrofuran, are preferred.

In addition to or instead of the conventional bleach activators, bleach catalysts can also be incorporated into the liquid laundry detergents and cleaning agents. These substances are bleach-intensifying transition-metal salts or transition-metal complexes such as, for example, Mn, Fe, Co, Ru, or Mo salt complexes or carbonyl complexes. Mn, Fe, Co, Ru, Mo, Ti, V, and Cu complexes having nitrogen-containing tripod ligands, as well as Co, Fe, Cu, and Ru ammine complexes, are also applicable as bleach catalysts.

Suitable enzymes are, in particular, those in the classes of hydrolases, such as proteases, esterases, lipases or lipolytically active enzymes, amylases, cellulases and other glycosyl hydrolases, and mixtures of the aforesaid enzymes. All these hydrolases contribute, in the laundry, to the removal of stains such as protein-, grease-, or starch-containing stains, and graying. Cellulases and other glycosyl hydrolases can moreover contribute to color retention and to enhanced textile softness by removing pilling and microfibrils. Oxidoreductases can also be used for bleaching and to inhibit color transfer. Enzymatic active substances obtained from bacterial strains or fungi, such as *Bacillus subtilis, Bacillus licheniformis, Streptomyceus griseus*, and *Humicola insolens*, are particularly suitable. Proteases of the subtilisin type, and in particular proteases obtained from *Bacillus lentus*, are preferably used. Enzyme mixtures, for example of protease and amylase or protease and lipase or lipolytically active enzymes, or protease and cellulase, or of cellulase and lipase or lipolytically active enzymes, or of protease, amylase, and lipase or lipolytically active enzymes, or protease, lipase or lipolytically active enzymes, and cellulase, but in particular protease- and/or lipase-containing mixtures or mixtures with lipolytically active enzymes, are of particular interest in this context. Examples of such lipolytically active enzymes are the known cutinases. Peroxidases or oxidases have also proven suitable in certain cases. The suitable amylases include, in particular, α-amylases, isoamylases, pullulanases, and pectinases. Cellobiohydrolases, endoglucanases, and β-glucosidases, which are also called cellobiases, and mixtures thereof, are preferably used as cellulases. Because different types of cellulase differ in terms of their CMCase and avicelase activities, the desired activities can be adjusted by means of controlled mixtures of the cellulases.

The bleach activators, bleach catalysts, and/or enzymes can be adsorbed onto carrier substances and/or encased in order to protect them from premature breakdown. The proportion of enzymes, liquid enzyme formulations, enzyme mixtures, or enzyme granulates can be, for example, approximately 0.1 wt % to 5 wt %, by preference 0.12 wt % to approximately 2.5 wt %, based in each case on the entire detergent.

A large number of very varied salts from the group of the inorganic salts can be used as electrolytes. Preferred cations are the alkali and alkaline-earth metals; preferred anions are the halides and sulfides. From a production-engineering standpoint, the use of NaCl or $MgCl_2$ in the detergents and agents is preferred. The proportion of electrolytes in the detergents and agents is usually no more than 8 wt %, in particular 0.5 to 5 wt %.

The use of pH-adjusting agents may be indicated in order to bring the pH of the liquid detergents and agents into the desired range. All known acids and bases are usable here, provided their use is not prohibited for applications-engineering reasons or in the interest of user safety. The quantity of such adjusting agents usually does not exceed 10 wt % of the entire formulation.

A further component contained, if desired, in detergents and agents according to the present invention is a hydrotrope. Preferred hydrotropes encompass the sulfonated hydrotropes such as, for example, the alkylarylsulfonates or alkylarylsulfonic acids. Preferred hydrotropes are selected from xylene-, toluene-, cumene-, naphthalenesulfonate or -sulfonic acid, and mixtures thereof. Counterions are by preference selected from sodium, calcium, and ammonium. If applicable, the liquid detergents and agents can encompass up to 20 wt % of a hydrotrope, in particular 0.05 wt % to 10 wt %.

In order to improve the aesthetic impression of the liquid detergents and agents, they can be colored with suitable dyes. Preferred dyes, the selection of which will present no difficulty to one skilled in the art, possess excellent shelf stability and insensitivity to the other ingredients of the detergents and agents and to light, and no pronounced substantivity with respect to textile fibers, in order not to color them.

Suitable foam inhibitors that can be used in the liquid laundry detergents and cleaning agents are, for example, soaps, paraffins, and silicone oils, which if applicable can also have been applied onto carrier materials.

Suitable anti-redeposition agents, which are also referred to as "soil repellents," are, for example, the polymers, known from the existing art, of phthalic acid and/or terephthalic acid and of their derivatives, in particular polymers of ethylene terephthalates and/or polyethylene glycol terephthalates or anionically and/or nonionically modified derivatives thereof. Of these, the sulfonated derivatives of the phthalic acid and terephthalic acid polymers are particularly preferred.

Optical brighteners can be added to the liquid laundry detergents and cleaning agents in order to eliminate yellowing of the treated textile fabrics. These substances absorb onto the fibers and cause brightening by converting ultraviolet radiation, which is invisible to the human eye, into longer-wave visible light, the ultraviolet light absorbed from sunlight being emitted as slightly bluish fluorescence and resulting, with the yellow tone of the yellowed laundry, in pure white. Suitable compounds derive, for example, from the substance classes of the 4,4'-diamino-2,2'-stilbenedisulfonic acids (flavonic acids), 4,4'-distyrylbiphenyls, methylumbelliferones, cumarins, dihydroquinolinones, 1,3-diarylpyrazolines, naphthalic acid imides, benzoxazole, benzisoxazole, and benzimidazole systems, and pyrene derivatives substituted with heterocycles. Optical brighteners are usually used in quantities of up to 0.5 wt %, in particular from 0.03 wt % to 0.3 wt %, based on the complete detergent or agent Because textile fabrics, in particular those made of rayon, viscose, cotton, and mixtures thereof, can tend to wrinkle because the individual fibers are sensitive to bending, kinking, pressing, and squeezing perpendicularly to the fiber direction, the detergents and agents according to the present invention can contain synthetic wrinkle-protection agents. These include, for example, synthetic products based on fatty acids, fatty acid esters, fatty acid amides, fatty acid alkylol esters, or fatty acid alkylolamides, or fatty alcohols that are usually reacted with ethylene oxide, or products based on lecithin or modified phosphoric acid esters.

In order to counteract microorganisms, the liquid laundry detergents and cleaning agents can contain antimicrobial active substances. A distinction is made here, depending on the antimicrobial spectrum and mechanism of action, between bacteriostatics and bactericides, fungistatics and fungicides, etc. Important substances from these groups are, for example, benzalkonium chlorides, alkylarylsulfonates, halogen phenols, and phenol mercuric acetate; these compounds can also be entirely dispensed with in the detergents and agents according to the present invention.

The detergents and agents can contain antioxidants in order to prevent undesired changes, caused by the action of oxygen and other oxidative processes, to the liquid laundry detergents and cleaning agents and/or the treated textile fabrics. This class of compounds includes, for example, substituted phenols, hydroquinones, catechols, and aromatic amines, as well as organic sulfides, polysulfides, dithiocarbamates, phosphites, and phosphonates. When such antioxidants are used, the detergents and agents according to the present invention are of course free of oxidizing bleaching agents.

Increased wearing comfort can result from the additional use of antistatic agents that are additionally incorporated into the detergents and agents. Antistatic agents increase the surface conductivity and thus make possible improved dissipation of charges that have formed. External antistatic agents are usually substances having at least one hydrophilic molecule ligand, and yield a more or less hygroscopic film on the surfaces. These usually surface-active antistatic agents can be subdivided into nitrogen-containing (amines, amides, quaternary ammonium compounds), phosphorus-containing (phosphoric acid esters), and sulfur-containing antistatic agents (alkylsulfonates, alkyl sulfates). External antistatic agents are, for example, lauryl (or stearyl) dimethylbenzylammonium chlorides suitable as antistatic agents for textile fabrics or as an additive to laundry detergents, an avivage effect additionally being achieved.

In order to improve the water absorption capability and rewettability of the treated textile fabrics and to facilitate ironing of the treated textile fabrics, silicone derivatives, for example, can be used in the liquid laundry detergents and washing agents. The silicone derivatives additionally improve the rinsing behavior of the detergents and agents as a result of their foam-inhibiting properties. Preferred silicone derivatives are, for example, polydialkyl- or alkylarylsiloxanes in which the alkyl groups have one to five carbon atoms and are entirely or partly fluorinated. Preferred silicones are polydimethylsiloxanes, which optionally can be derivatized and are then aminofunctional or quaternized or have Si—OH, Si—H, and/or Si—Cl bonds. The viscosities of the preferred silicones are in the range between 100 and 100,000 mPas at 25° C.; the silicones can be used in quantities between 0.2 and 5 wt % based on the entire detergent or agent.

Lastly, the liquid laundry detergents and cleaning agents can also contain UV absorbers, which are absorbed onto the treated textile fabrics and improve the light-fastness of the fibers. Compounds that exhibit these desired properties are, for example, the compounds that act by radiationless deactivation, and derivatives of benzophenone having substituents in the 2- and/or 4-position. Also suitable are substituted benzotriazoles, acrylates phenyl-substituted in the 3-position (cinnamic acid derivatives) optionally having cyano groups in the 2-position, salicylates, organic Ni complexes, and natural substances such as umbelliferone and endogenous urocanic acid.

Substances that complex heavy metals can be used in order to avoid the heavy metal-catalyzed decomposition of certain laundry detergent ingredients. Suitable heavy metal complexing agents are, for example, the alkali salts of ethylenediaminetetraacetic acid (EDTA) or of nitrilotriacetic acid (NTA), as well as alkali-metal salts of anionic polyelectrolytes such as polymaleates and polysulfonates.

A preferred class of complexing agents is the phosphonates, which are contained in preferred liquid detergents and agents in quantities from 0.01 wt % to 2.5 wt %, by preference from 0.02 wt % to 2 wt %, and in particular from 0.03 wt % to 1.5 wt %. Included among these preferred compounds are, in particular, organophosphonates such as, for example, 1-hydroxyethane-1,1-diphosphonic acid (HEDP), aminotri(methylenephosphonic acid) (ATMP), diethylenetriamine penta (methylenephosphonic acid) (DTPMP or DETPMP), and 2-phosphonobutane-1,2,4-tricarboxylic acid (PBS-AM), which are usually used in the form of their ammonium or alkali-metal salts.

The liquid laundry detergents are by preference clear, i.e., they do not exhibit any sediment and are transparent or at least translucent. The liquid laundry detergents and cleaning agents preferably have, without addition of a dye, a visible-light transmission (410 to 800 nm) of at least 30%, by preference at least 50%, and particularly preferably at least 75%.

In addition to the aforesaid constituents, however, a liquid laundry detergent and cleaning agent can also contain therein dispersed particles whose diameter along their greatest spatial extension is, for example 0.01 μm to 10,000 μm. Such particles can be both microcapsules or speckles, as well as granulates, compounds, and scent beads, microcapsules or speckles being preferred.

The term "microcapsule" is understood to mean aggregates that contain at least one solid or liquid core that is surrounded by at least one continuous casing, in particular a casing made of polymer(s). Finely dispersed liquid or solid phases encased with film-forming polymers are usually involved, in the manufacture of which phases the polymers, after emulsification and coacervation or interfacial polymerization, become deposited on the encasing material. The microscopically small capsules can be dried like powder. In addition to single-core microcapsules, multiple-core aggregates (also called microspheres) are known; these contain two or more cores distributed in the continuous casing material. Single- or multiple-core microcapsules can additionally be surrounded by an additional second, third, etc. casing. Single-core microcapsules having a continuous casing are preferred. The casing can be made of natural, semi-synthetic, or synthetic materials. Natural casing materials are, for example, gum arabic, agar-agar, agarose, maltodextrins, alginic acid or salts thereof, e.g., sodium or calcium alginate, fats and fatty acids, cetyl alcohol, collagen, chitosan, lecithins, gelatin, albumin, shellac, polysaccharides such as starch or dextran, sucrose, and waxes. Semi-synthetic casing materials are, among others, chemically modified celluloses, in particular cellulose esters and ethers, for example cellulose acetate, ethyl cellulose, hydroxypropyl cellulose, hydroxypropylmethyl cellulose, and carboxymethyl cellulose, as well as starch derivatives, in particular starch ethers and esters. Synthetic casing materials are, for example, polymers such as polyacrylates, polyamides, polyvinyl alcohol, or polyvinylpyrrolidone.

Sensitive, chemically or physically incompatible, or volatile components (=active substances) of the liquid detergent or agent can be enclosed in the interior of the microcapsule in storage- and transport-stable fashion. For example, optical brighteners, surfactants, complexing agents, bleaching agents, bleach activators, dyes and fragrances, antioxidants, detergency builders, enzymes, enzyme stabilizers, antimicrobial active substances, antiredeposition agents, pH adjusting agents, electrolytes, foam inhibitors, and/or UV absorbers can be present in the microcapsules. In addition to the constituents recited above as ingredients of the aqueous liquid detergents and agents according to the present invention, the microcapsules can contain, for example, vitamins, proteins, preservatives, washing power intensifiers, or luster agents. The fillings of the microcapsules can be solids, or liquids in the form of solutions or emulsions or suspensions.

The microcapsules can have any shape within the context governed by manufacture, but are preferably approximately spherical. Their diameter along their greatest physical extension can be between 0.01 μm (not visually detectable as a capsule) and 10,000 μm, depending on the application and the components contained in their interior. Visible microcapsules having a diameter in the range from 100 μm to 7,000 μm, in particular 400 μm to 5,000 μm, are preferred. The microcapsules are accessible in accordance with methods known in the existing art, coacervation and interfacial polymerization having the greatest significance. All surfactant-stable microcapsules offered on the market can be used as microcapsules, for example the commercial products (the respective casing material being indicated in parentheses) Hallcrest Microcapsules (gelatin, gum arabic), Coletica Thalaspheres (maritime collagen), Lipotec Millicapsules (alginic acid, agar-agar), Induchem Unispheres (lactose, microcrystalline cellulose, hydroxypropylmethyl cellulose); Unicerin C30 (lactose, microcrystalline cellulose, hydroxypropylmethyl cellulose), Kobo Glycospheres (modified starch, fatty acid esters, phospholipids), Softspheres (modified agar-agar), and Kuhs Probiol Nanospheres (phospholipids).

Alternatively, it is also possible to use particles that do not have a core/casing structure but in which the active substance is distributed in a matrix made of a matrix-forming material. Such particles are also referred to as "speckles." A preferred matrix-forming material is alginate. For the manufacture of alginate-based speckles, an aqueous alginate solution that also contains the active substance or substances to be enclosed is drip-processed and then hardened in a precipitation bath containing $Ca^{2+}$ ions or $Al^{3+}$ ions. It may be advantageous for the alginate-based speckles subsequently to be washed with water and then in an aqueous solution having a complexing agent, in order to wash out free $Ca^{2+}$ ions or free $Al^{3+}$ ions that can enter into undesirable interactions with ingredients, for example the fatty acid soaps, of the liquid laundry detergent and cleaning agent. The alginate-based speckles are then washed with water in order to remove excess complexing agent. Alternatively, other matrix-forming materials can be used instead of alginate. Examples of matrix-forming materials encompass polyethylene glycol, polyvinylpyrrolidone, polymethacrylate, polylysin, poloxamer, polyvinyl alcohol, polyacrylic acid, polyethylene oxide, polyethoxyoxazoline, albumin, gelatin, acacia, chitosan, cellulose, dextran, Ficoll®, starch, hydroxyethyl cellulose, hydroxypropyl cellulose, hydroxypropylmethyl cellulose, hyaluronic acid, carboxymethyl cellulose, carboxymethyl cellulose, deacetylated chitosan, dextran sulfate, and derivatives of these materials. With these materials, matrix formation is usually accomplished by gelling, polyanion-polycation interactions, or polyelectrolyte-metal ion interactions, and is well known in the existing art in just the same way as the manufacture of particles with these matrix-forming materials. The particles can be dispersed in stable fashion in the aqueous liquid laundry detergents and cleaning agents. "Stable" means that at room temperature and at 40° C., the detergents and agents are stable over a period of at least 4 weeks, and preferably at least 6 weeks, with no creaming or sedimentation of the detergents or agents.

Release of the active substances from the microcapsules or speckles usually takes place, during utilization of the detergents or agents containing them, by destruction of the casing or of the matrix as a result of mechanical, thermal, chemical, or enzymatic action. In a preferred embodiment of the invention, the liquid laundry detergents contain identical or different particles in quantities from 0.01 to 10 wt %, in particular 0.2 to 8 wt %, and extremely preferably 0.5 to 5 wt %.

Aqueous laundry detergents and cleaning agents can be manufactured easily and economically in usual mixing and filling facilities. For manufacture of the liquid detergents and agents, preferably firstly the acid components, if present, such as e.g., the linear alkylsulfonates, citric acid, boric acid, phosphonic acid, the fatty alcohol ether sulfates, and the nonionic surfactants, are made ready. The solvent component is by preference also added at this point in time, but can also be added at a later time. The complexing agent, if present, is added to these components. A base such as, for example, NaOH, KOH, triethanolamine, or monoethanolamine, is then added, followed by the fatty acid, if present. Subsequent thereto, the remaining ingredients and, if applicable, the remaining solvents of the aqueous liquid detergent or agent are added to the mixture, and the pH is adjusted to the desired value. Lastly, if desired, the particles to be dispersed are added, and are homogeneously distributed in the aqueous liquid detergent or agent by mixing.

EXAMPLES

Table 1 indicates the composition (ingredients in weight percent, based in each case on the entire detergent) of laundry detergents M1 and M2 according to the present invention.

TABLE 1

| | M1 | M2 |
|---|---|---|
| $C_{9-13}$ alkylbenzenesulfonate, Na Salt | 10 | 10 |
| Sodium lauryl ether sulfate having 2 EO | 5 | 5 |
| $C_{12-14}$ fatty alcohol having 7 EO | 10 | 10 |
| $C_{12-14}$ alkylglucoside | 2 | 2 |
| $C_{12-18}$ fatty acid, Na salt | 8 | 8 |
| Glycerol | 5 | 5 |
| Trisodium citrate | 1 | 1 |
| Polyacrylate | 2 | 2 |
| Me-CMC I[a)] | 1 | – |
| Me-CMC II[b)] | – | 1 |
| Enzymes, dye, optical brightener | + | + |
| Water | to make 100 | to make 100 |

[a)]Degree of methylation 0.09, degree of carboxymethylation 0.56, molar weight 218,000
[b)]Degree of methylation 0.14, degree of carboxymethylation 0.73, molar weight 198,000

The detergents were tested under the following conditions:

| | |
|---|---|
| Washing unit: | Launderometer, Atlas company |
| Balls: | 10 |
| Washing temperature: | 40° C., 60 min. |
| Determinations: | ×3 |
| No. of washes: | 5 |
| Bath ratio: | 1:12 |
| Water hardness: | 16° dH |
| Dirt carrier: | 6.7 g Graying Swatch |
| Proportion: | 1 g of detergent/200 ml |

The following materials were used:

| | |
|---|---|
| A | 65% polyester/35% cotton, WFK 20A |
| B | 100% cotton Trigema ® jersey, pink |
| C | 100% cotton Trigema ® pique, light yellow |
| D | 100% cotton twisted-yarn terrycloth, 1.1.04, white with optical brighteners |
| E | 100% cotton, cotton knit, 1.1.27, double rib fabric, bleached, with optical brightener |
| F | 100% cotton, cotton woven fabric, WFK 10A, no optical brightener. |

Table 2 indicates the percentage improvement in graying inhibition that resulted from use of the low-methylated carboxymethyl cellulose (as compared with a detergent of otherwise identical composition from which this active substance was absent).

TABLE 2

| | M1 | M2 |
|---|---|---|
| A | 5.5 | 4.6 |
| B | 5.6 | 7.3 |
| C | 12.0 | 10.1 |
| D | 10.4 | 10.5 |
| E | 17.4 | 13.6 |
| F | 11.4 | 11.3 |

The invention claimed is:

1. An aqueous liquid laundry detergent comprising:

methylcarboxymethyl cellulose having a degree of methylation in the range from 0.01 to 0.3, at least one surfactant wherein the at least one surfactant is at least a sodium salt of a $C_{12-18}$ saturated or unsaturated fatty acid present in an amount of 5 to 10 weight % based on total weight of the detergent, and at least one substance selected from the group consisting of detergency builders, bleaching agents, bleach activators, enzymes, electrolytes, pH adjusting agents, fragrances, perfume carriers, fluorescent agents, dyes, hydrotropes, foam inhibitors, additional anti-redeposition agents or graying inhibitors, optical brighteners, shrinkage preventers, wrinkle protection agents, color transfer inhibitors, antimicrobial active substances, germicides, fungicides, antioxidants, corrosion inhibitors, antistatic agents, ironing adjuvants, proofing and impregnating agents, swelling and anti-slip agents, and UV absorbers.

2. The detergent according to claim 1, wherein the methylcarboxymethyl cellulose has a degree of carboxymethylation in the range from 0.3 to 1.

3. The detergent according to claim 1, wherein the methylcarboxymethyl cellulose has a degree of methylation in the range from 0.05 to 0.2.

4. The detergent according to claim 1, wherein the methylcarboxymethyl cellulose is present in an amount of from 0.1 to 2 wt % based on total weight of the detergent.

5. The detergent according to claim 1, wherein the total amount of surfactant present is in an amount of from 10 wt % to 60 wt % based on total weight of the detergent.

6. The detergent according to claim 1 further comprising an anionic surfactant differing from the anionic fatty acid soap and chosen from alkylbenzene sulfonate, ether sulfate, and soap.

7. The detergent according to claim 1, wherein the at least one surfactant is further at least a nonionic surfactant and the nonionic surfactant is at least an alcohol alkoxylate.

8. The detergent according to claim 7, wherein the nonionic surfactant is selected from the group consisting of alcohol alkoxylate, alkylpolyglycoside and mixtures thereof.

9. The detergent according to claim 1 further comprising up to 85 wt % water based on total weight of the detergent.

10. A method of inhibiting the graying of textile fabrics during the washing of the fabrics which comprises the step of applying to the fabrics during washing an aqueous liquid laundry detergent containing methylcarboxymethyl cellulose having a degree of methylation in the range from 0.01 to 0.3, at least one surfactant wherein the at least one surfactant is at least a sodium salt of a $C_{12}$-18 saturated or unsaturated fatty acid present in an amount of 5 to 10 weight % based on total weight of the detergent, and at least one substance selected from the group consisting of detergency builders, bleaching agents, bleach activators, enzymes, electrolytes, pH adjusting agents, fragrances, perfume carriers, fluorescent agents, dyes, hydrotropes, foam inhibitors, additional anti-redeposition agents or graying inhibitors, optical brighteners, shrinkage preventers, wrinkle protection agents, color transfer inhibitors, antimicrobial active substances, germicides, fungicides, antioxidants, corrosion inhibitors, antistatic agents, ironing adjuvants, proofing and impregnating agents, swelling and anti-slip agents, and UV absorbers.

11. The method according to claim 10, wherein the methylcarboxymethyl cellulose has a degree of carboxymethylation in the range from 0.3 to 1.

12. The method according to claim 10, wherein the methylcarboxymethyl cellulose has a degree of carboxymethylation in the range from 0.05 to 0.2.

13. The method according to claim 10, wherein the methylcarboxymethyl cellulose is present in an amount of from 0.1 to 2 wt % based on total weight of the detergent.

14. The method according to claim 10, wherein the total amount of surfactant present is in an amount of from 10 wt % to 60 wt % based on total weight of the detergent.

15. The method according to claim 10 further comprising an anionic surfactant differing from the anionic fatty acid soap and chosen from alkylbenzene sulfonate, ether sulfate, and soap.

16. The method according to claim 10, wherein the at least one surfactant is further at least a nonionic surfactant and the nonionic surfactant is at least an alcohol alkoxylate.

17. The method according to claim 10, wherein the detergent further comprises up to 85 wt % water based on total weight of the detergent.

18. A method of inhibiting the graying of textile fabrics during the washing of the fabrics which comprises the step of applying to the fabrics during washing an aqueous liquid detergent containing methylcarboxymethyl cellulose having a degree of methylation in the range of 0.01 to 0.3, sodium $C_{9-13}$ alkylbenzene sulfonate, sodium lauryl ether sulfate having 2 EO groups, $C_{12-14}$ fatty alcohol having 7 EO groups, $C_{12-14}$ alkylglucoside, sodium salt of $C_{12-18}$ fatty acid, trisodium citrate, polyacrylate and water.

* * * * *